United States Patent [19]

Klem

[11] 3,978,965

[45] Sept. 7, 1976

[54] RIBBON CARTRIDGE FOR AUTOMATIC TYPEWRITER FUNCTION

[75] Inventor: Stanley J. Klem, Cortland, N.Y.

[73] Assignee: SCM Corporation, New York, N.Y.

[22] Filed: June 23, 1975

[21] Appl. No.: 589,646

[52] U.S. Cl. ..... 197/151; 197/181

[51] Int. Cl.[2] ..... B41J 33/02; B41J 19/62

[58] Field of Search ..... 197/82, 83, 91, 151, 197/168, 169, 181, 107, 6.7; 242/55, 57

[56] References Cited

UNITED STATES PATENTS

| | | | |
|---|---|---|---|
| 1,475,619 | 11/1923 | Barney | 197/51 |
| 1,608,279 | 11/1926 | Handley | 197/51 |
| 3,194,379 | 7/1965 | Szeluga | 197/151 |
| 3,204,746 | 9/1965 | Wolowitz | 197/181 X |
| 3,346,090 | 10/1967 | Goff et al. | 197/158 |
| 3,632,052 | 1/1972 | Read | 197/160 X |
| 3,637,060 | 1/1972 | McMahon | 197/6.7 |
| 3,643,778 | 2/1972 | Anderson | 197/151 |
| 3,729,081 | 4/1973 | Ozimek et al. | 197/181 X |
| 3,804,227 | 4/1974 | Cappotto et al. | 197/151 |
| 3,882,990 | 5/1975 | Genesio | 197/181 |
| 3,927,746 | 12/1975 | Wolowitz | 197/151 |
| 3,927,747 | 12/1975 | Wolowitz | 197/151 |
| 3,927,748 | 12/1975 | Wolowitz | 197/181 |
| 3,927,749 | 12/1975 | Wolowitz | 197/181 |

*Primary Examiner*—Edgar S. Burr
*Assistant Examiner*—Paul T. Sewell
*Attorney, Agent, or Firm*—Stanley J. Klem; Milton M. Wolson

[57] ABSTRACT

An insertable and removable typewriter cartridge having an abutment thereon for automatically engaging a function coupled responsive means of a typewriter to actuate the typewriter function mechanism when the cartridge is removed from the typewriter.

12 Claims, 5 Drawing Figures

RIBBON CARTRIDGE FOR AUTOMATIC TYPEWRITER FUNCTION

BACKGROUND OF THE INVENTION

The present invention relates generally to insertable and removable typewriter ribbon cartridges of the type disclosed in U.S. Pat. No. 3,643,777 entitled TYPEWRITER RIBBON CARTRIDGE granted on Feb. 22, 1972 and United States Patent Application Ser. No. 150,946 filed June 9, 1971 entitled TYPEWRITER RIBBON CARTRIDGE both of which are assigned to the assignee of the instant application. The present invention cooperates with a typewriter borne mechanism that is clearly described in co-pending United States Patent Application entitled AUTOMATIC FUNCTION MECHANISM FOR TYPEWRITERS filed simultaneously with the instant application with Stanley J. Klem as sole inventor and assigned to the same assignee. The invention in its broadest aspects is not restricted to this ribbon cartridge structure, but has been illustrated and described for explanatory purposes and could readily be adapted to other ribbon cartridge structures. The ribbon cartridge of the present invention may include an error correction ribbon disposed therein whereby the correction ribbon is guided from the correction ribbon cartridge supply chamber along an integral ribbon guide arm that extends from the correction ribbon cartridge supply chamber to the typewriter print station. More specifically, the present invention is concerned with a modified ribbon cartridge construction that includes a pivotal abutment thereon to engage a backspace coupled responsive member thereby actuating the backspace mechanism to reposition the typewriter carriage to the proper print station.

When it is desired to correct an error, a printing ribbon cartridge is removed from the typewriter and the modified ribbon cartridge is inserted. During insertion, the cartridge borne pivotal abutment engages the backspace coupled responsive member. However, no actuation of the backspace mechanism takes place since the pivotal abutment on the modified ribbon cartridge pivots clear of the responsive member until the abutment is inserted beyond the responsive member. The pivotal abutment is then biased to return to its actuable state. After the error is corrected, the modified ribbon cartridge is removed from the typewriter. As the modified ribbon cartridge is removed, the pivotal abutment now prevented from pivoting, engages the backspace coupled responsive member and actuates the backspace mechanism to reposition the typewriter carriage to the proper print station where the correct character is typed.

The correction of errors in typewriters as disclosed in the prior art required a series of sequential manually manipulative operations so that the carriage of the typewriter may be backspaced a plurality of times to correct the error. For example, when an operator typed an erroneous character, it first became necessary to manually depress the backspace key thereby actuating the backspace mechanism to reposition the typewriter carriage to the proper print station for making the correction. After the erroneous typed character is removed by striking over the character through the correction ribbon, the backspace key was again manually depressed to actuate the backspace mechanism a second time. The typewriter carriage is repositioned to the proper printing station a second time and then the correct character is typed. Therefore, a series of manually manipulative operations by the operator were necessary to correct an erroneously typed character. The end result of the foregoing disadvantages of the prior art is that the typing speed is significantly reduced, total typing time is increased and the possibility of compounding the error by inadvertent multiple backspacing is increased.

The present invention overcomes the obvious disadvantages of the prior art in that the manual manipulation required to actuate the backspace mechanism and reposition the typewriter carriage to the proper print station after an error correction operation is reduced just by inserting and removing the ribbon cartridge.

SUMMARY OF THE INVENTION

The inventive concept of the illustrated embodiment of the present invention contemplates an insertable and removable ribbon cartridge which is so structured that only upon its removal, will it actuate one or more typewriter functions.

The term "typewriter function" is defined to include any typewriter operation which provides for the alignment of a selected platen impact point relative to the typewriter print point.

As depicted in the illustrated embodiment, an insertable and removable ribbon cartridge cooperates with a typewriter automatic backspace actuating mechanism to actuate the backspace function in a typewriter. One physical embodiment of the concept as it is applied to an error correction operation, comprises a ribbon cartridge and includes a pivotal abutment disposed on its top. The pivotal abutment projects from the periphery of the ribbon cartridge into the path of an actuating lever of the backspace actuating machanism. The pivotal abutment is ineffective upon ribbon cartridge insertion and effective to actuate the backspace function upon removal of the ribbon cartridge from the typewriter after completing the error correction operation.

Although the physical embodiment of the invention has been directed to one application, namely error correction, it is clear that it could actuate a variety of typewriter functions, either singly, in combination, or sequentially.

Accordingly, it is an object of the present invention to provide an insertable and removable ribbon cartridge for a typewriter that will automatically actuate one or more selected typewriter functions when the ribbon cartridge is removed from the typewriter.

Another object of the present invention is to provide an insertable and removable ribbon cartridge for a typewriter that will automatically actuate the backspace mechanism when the ribbon cartridge is removed from the typewriter.

A further object of the present invention is to provide an insertable and removable ribbon cartridge for a typewriter that is ineffective upon ribbon cartridge insertion and effective upon ribbon cartridge removal to actuate the typewriter backspace mechanism.

A still further object of the present invention is to provide a simple and inexpensive means for adapting a ribbon catridge to automatically actuate the backspace mechanism of a typewriter that is readily adaptable to existing ribbon cartridges.

Other objects, features, and advantages of the invention will become more apparent from the following description, including appended claims, and accompanying drawing.

DESCRIPTION OF THE PREFERRED EMBODIMENT

For the purpose of clarity and ease of description, the disclosed embodiment is confined to a common and readily employed function, namely backspacing for error correction. However, the principle of this invention can be readily applied to other typewriter functions utilizing the embodiment described herein as an example.

Figure 1:
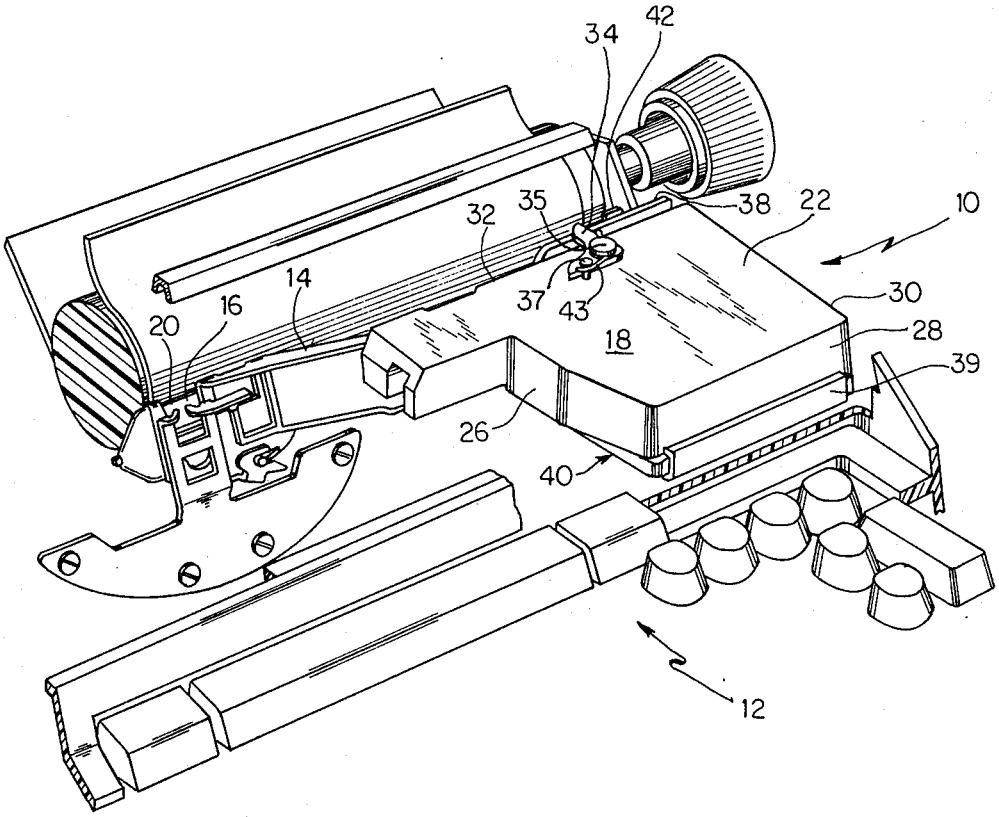
FIG. 1 is a perspective view of a portion of a typewriter having inserted therein a ribbon cartridge embodiment of the instant invention.
Figure 2:
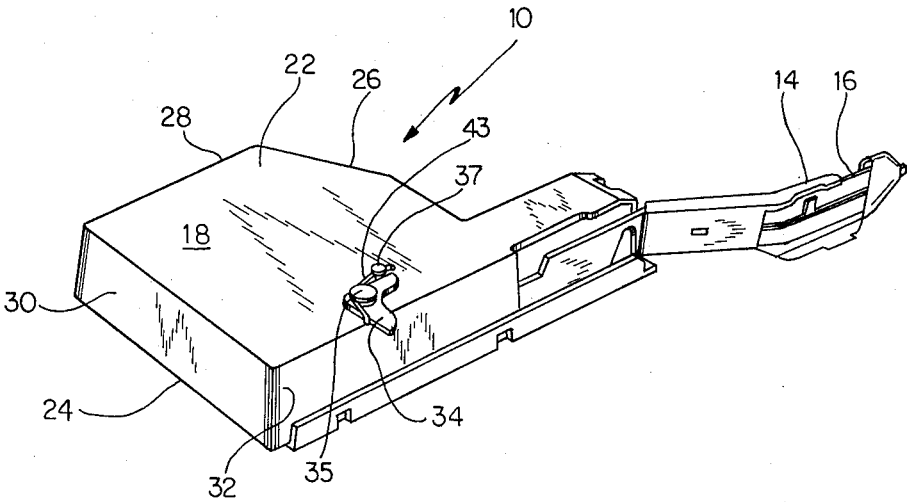
FIG. 2 is a rear perspective view of an embodiment of a ribbon cartridge made in accordance with the instant invention.

Referring now to the drawings and in particular to FIGS. 1 and 2 showing a typewriter 12 with a modified ribbon cartridge 10 supported therein and having an arm 14 extending therefrom. An error correction ribbon 16 is disposed in a housing 18 of ribbon cartridge 10 hereafter referred to as an error correction ribbon cartridge. The ribbon 16 is guided along arm 14 to the typewriter print station 20 and then back to housing 18. The internal construction of error correction ribbon cartridge 10 is fully described in the previously mentioned patent and patent applications, and is illustrative of one type of cartridge to which the inventive concept may be applied.

The error correction ribbon cartridge housing 18 is comprised of a top portion 22 and a base portion 24 spaced from top portion 22 by depending walls 26, 28, 30 and 32.

The inventive concept as illustrated is applied in one particular embodiment to a specific cartridge for the sake of illustrative clarity and may take other forms as well as be adaptable to other types of cartridges.

Figure 3:
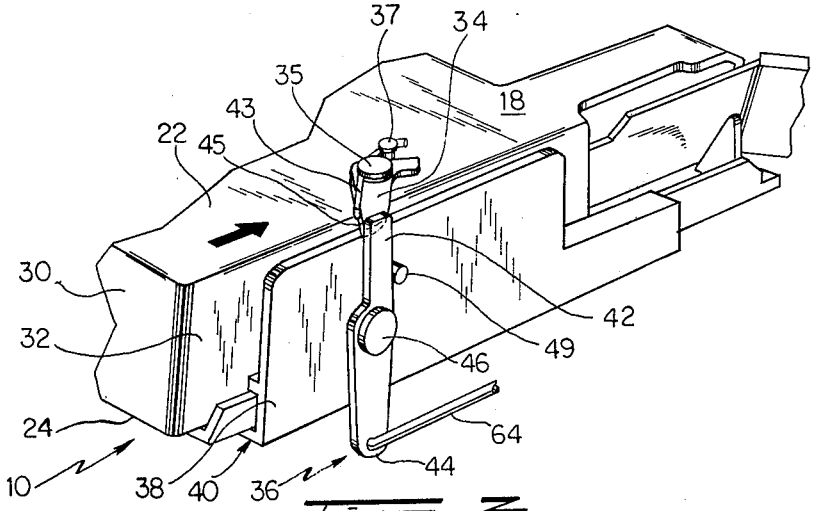
FIG. 3 is an enlarged rear perspective view of a portion of the ribbon cartridge as the ribbon cartridge is being inserted into the typewriter.
Figure 4:
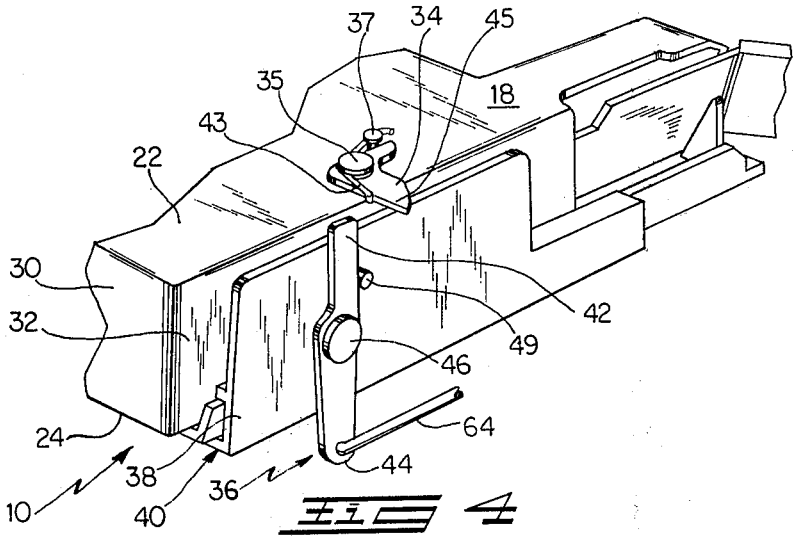
FIG. 4 is a view as shown in FIG. 3 showing the ribbon cartridge in its fully inserted state.
Figure 5:
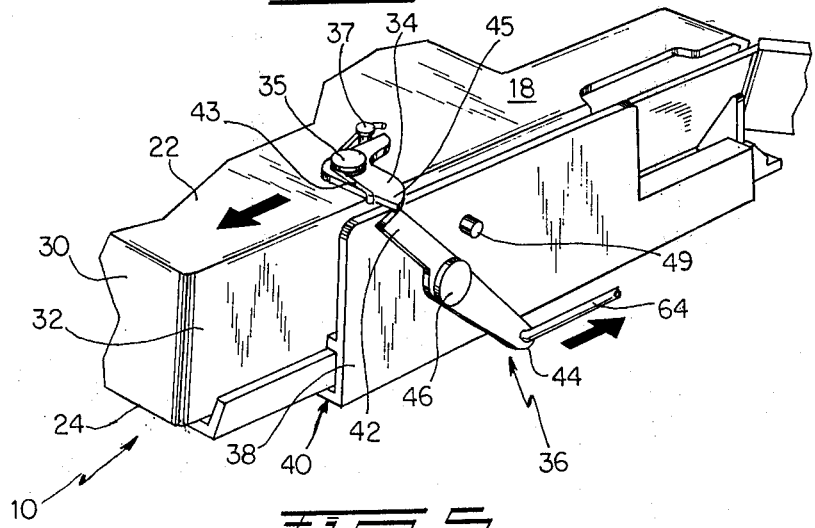
FIG. 5 is a view as shown in FIG. 4 showing the ribbon cartridge as it is being removed from the typewriter.

Error correction ribbon cartridge 10 is provided with a pivotal abutment 34 a portion of which is disposed in the path of an actuating lever 36 when error correction ribbon cartridge 10 is inserted into the typewriter, clearly shown in FIGS. 3, 4, and 5. Abutment 34 is pivotally disposed on cartridge top 22 about a pivot stud 35 and is biased against an upstanding stop pin 37 by a spring 43. Stop pin 37 prevents rotation of abutment 34 in a counterclockwise direction and allows rotation in a clockwise direction. An extension 45 of abutment 34 projects beyond the cartridge periphery a sufficient distance to intersect actuating lever 36 upon insertion and removal of error correction ribbon cartridge 10. In typewriters adapted for using ribbon cartridges, multiple backspacing operations are required. However, the final backspace operation required is automated as error correction ribbon cartridge 10 of the instant invention is removed from the typewriter.

Actuating lever 36 is pivotally supported on a guide wall 38 of a ribbon cartridge platform 40 as shown in FIGS. 1, 3, 4, and 5. One appropriate ribbon cartridge platform 40 is fully disclosed in co-pending patent application entitled AUTOMATIC FUNCTION MECHANISM FOR TYPEWRITERS, to be filed simultaneously with the instant application and having the same inventor and assignee. Typewriter 12 is provided with means for actuating its backspace function that may be disposed proximate the opening that receives the error correction ribbon cartridge 10 and in the path of means associated with the error correction ribbon cartridge 10 to actuate the same.

One such actuating mechanism which has been found to operate satisfactorily is hereafter described.

The backspace actuating mechanism best shown in FIGS. 3, 4, and 5 includes actuating lever 36 that connects to an appropriate backspace mechanism. Actuating lever 36 is pivotally supported intermediate its ends 42 and 44 by a pivot stud 46 that projects outward from wall 38. As shown in FIG. 3, actuating lever 36 is prevented from pivoting by virtue of its contact with projecting stop pin 49 and is allowed to pivot counterclockwise as shown in FIG. 5. End 42 extends upwards a sufficient distance where it intersects the insertion path of abutment 34. End 44 extends downward and includes a link 64 attached thereto.

The present invention automates the error correction procedure and reduces the undesirable procedure of multiple backspace operations that are normally required to correct an erroneously typed character. During normal practice when an operator types an erroneous character on a typewriter containing the automated backspace mechanism of the present invention, the following sequence of operations are required to correct the error. It is necessary that a backspace function be manually actuated to reposition typewriter carriage 13 to the proper print station for making the correction. The operator removes a printing ribbon cartridge from typewriter 12 and inserts error correction ribbon cartridge 10. Error correction ribbon cartridge 10 is inserted into the typewriter 12 where it is supported by base 41 of ribbon cartridge platform 40 and precisely guided by platform upstanding walls 38 and 39. As error correction ribbon cartridge 10 is progressively slid along ribbon cartridge platform 40, abutment 34 abuts actuating lever 36 and is urged to pivot clockwise about its pivot 35 as shown in FIG. 3. As error correction ribbon cartridge 10 continues to be inserted, abutment 34 slides along actuating lever 36 until it is beyond the outermost point of upper member 42 where it is free to snap to its actuable mode under the urge of spring 43 as shown in FIG. 4. After completion of the error correction operation, the error correction ribbon cartridge 10 is removed.

The insertion of error correction ribbon cartridge 10 does not actuate a typewriter function but merely positions a supply of error correction ribbon 16 at typewriter print station 20.

As error correction ribbon cartridge 10 is progressively removed from typewriter 12, abutment 34, nonpivotal in a counterclockwise direction by virtue of its contact with stop pin 37, abuts actuating lever 36 and urges actuating lever 36 to pivot counterclockwise as shown in FIG. 5. As actuating lever 34 pivots, a backspace function is actuated.

It is obvious from the foregoing description that the accomplishment of the final backspacing operation after an error correction operation has been completed by simply removing the error correction ribbon cartridge from the typewriter is a significant advantage to a typist. For example, after several backspacing operations and the covering of an erroneous typed character with correction material, no further manual backspacing is required. The operator need only remove the error correction ribbon cartridge 10 whereupon the final backspacing operation occurs, insert a printing ribbon cartridge and then continue typing, whereby the possibility of forgetting the final backspace operation is prevented.

It is clear from the foregoing description that where a typewriter is adapted with response means for actuating a selected typewriter function, the use thereof requires only the step of removing a suitable insertable and removable cartridge therefrom.

While the foregoing description has shown and described the fundamental novel features as applied to a preferred embodiment, it will be understood by those skilled in the art that modifications embodied in various forms may be made without departing from the spirit and scope of the invention.

What is claimed is:

1. A cartridge for a typewriter, which typewriter includes means for receiving the cartridge and actuable means to perform a typewriter function for causing the alignment of a selected platen impact point relative to the typewriter print point, the cartridge comprising:

an abutment carried on the cartridge having means yieldable relative to the cartridge upon cartridge insertion and rigid relative to the cartridge upon cartridge removal for actuating the typewriter actuable means to thereby perform the typewriter function.

2. A cartridge as defined in claim 1 wherein said yieldable means is in the path of said actuable means for actuating the typewriter function upon cartridge removal.

3. A cartridge as defined in claim 1 wherein said cartridge includes a stop member and said yieldable means is biased into contact with said stop member for rendering said yieldable means rigid.

4. A cartridge as defined in claim 1 wherein said yieldable means and said stop member are disposed on the top surface of the cartridge.

5. A ribbon cartridge for a typewriter, which typewriter includes means for receiving the ribbon cartridge and operational means for backspacing a typewriter carriage, the ribbon cartridge comprising:

an abutment carried on the ribbon cartridge having means yieldable relative to the ribbon cartridge upon cartridge insertion and rigid relative to the ribbon cartridge upon cartridge removal for actuating the typewriter operational means to thereby backspace the typewriter carriage.

6. A ribbon cartridge as defined in claim 5 wherein said yieldable means is in the path of said operational means for actuating the typewriter operational means upon cartridge removal.

7. A ribbon cartridge as defined in claim 5 wherein said ribbon cartridge includes a stop member and said yieldable means is biased into contact with said stop member for rendering said yieldable means rigid.

8. A ribbon cartridge as defined in claim 5 wherein said yieldable means and said stop member are disposed on the top surface of the ribbon cartridge.

9. An automatic backspacing ribbon cartridge for a typewriter having a traversable carriage, a fixed ribbon cartridge platform for supporting and guiding the ribbon cartridge to the typewriter print station when the ribbon cartridge is inserted into the typewriter; an actuating mechanism pivotally supported on the ribbon cartridge platform, and a backspace mechanism responsive to the actuating mechanism for incrementally reversing the forward traverse of the carriage, the ribbon cartridge comprising:

an abutment carried on the ribbon cartridge having means yieldable relative to the ribbon cartridge upon cartridge insertion and rigid relative to the ribbon cartridge upon cartridge removal for engaging the actuating mechanism for actuating the typewriter backspace mechanism.

10. A ribbon cartridge as defined in claim 9 wherein said yieldable means is in the path of said actuating mechanism for actuating the typewriter backspacing mechanism upon ribbon cartridge removal.

11. A ribbon cartridge as defined in claim 9 wherein said ribbon cartridge includes a stop member and said yieldable means is biased into contact with said stop member for rendering said yieldable means rigid.

12. A ribbon cartridge as defined in claim 9 wherein said yieldable means and said stop member are disposed on the top surface of the ribbon cartridge.

* * * * *